United States Patent [19]

Stempfle

[11] Patent Number: 4,979,836

[45] Date of Patent: Dec. 25, 1990

[54] MATRIX PIN PRINT HEAD OF THE HINGED-CLAPPER-ARMATURE CONSTRUCTION

[75] Inventor: Johann Stempfle, Pfaffenhofen, Fed. Rep. of Germany

[73] Assignee: Mannesmann Aktiengesellschaft, Düsseldorf, Fed. Rep. of Germany

[21] Appl. No.: 443,755

[22] Filed: Nov. 30, 1989

[30] Foreign Application Priority Data

Dec. 1, 1988 [EP] European Pat. Off. ..... 88730265

[51] Int. Cl.[5] ..... B41J 2/23

[52] U.S. Cl. ..... 400/124; 101/93.05

[58] Field of Search ..... 400/124; 335/298, 297; 101/93.05

[56] References Cited

U.S. PATENT DOCUMENTS

| | | | |
|---|---|---|---|
| 3,860,895 | 1/1975 | Chow et al. | 335/298 |
| 4,541,745 | 9/1985 | Gugel | 400/124 |
| 4,832,515 | 5/1989 | Kawakami | 400/124 |

FOREIGN PATENT DOCUMENTS

| | | | |
|---|---|---|---|
| 84942 | 4/1988 | Japan | 400/124 |

*Primary Examiner*—Edgar S. Burr
*Assistant Examiner*—C. A. Bennett
*Attorney, Agent, or Firm*—Horst M. Kasper

[57] ABSTRACT

A matrix pin print head of the hinged clapper armature construction includes several pin systems, where each pin system comprises a magnet yoke limb pair (1), an electromagnetic coil (2), a hinged clapper armature (3), and a print pin (4). A higher pin system number naturally results in a larger print head or nominal diameter (5). In addition, an electomagnetic coil support (11) is provided, which is produced by sintering or precision casting and which forms a single-piece component (21) together with a base plate and the magnet yoke pairs (1). In order to achieve an advantageous guiding of the armature, in particular for high-number pin systems with, for example, 18 or 24 print pins, without a loss in magnetic energy, the electromagnetic coil support (11) exhibits radially outwardly disposed individual magnet yoke limbs (1*a*), which magnet yoke limbs (1*a*), in each case, are directed to a pin engagement point (15) between the pin head (4*a*) and the hinged clapper armature (3), such that the radially inner magnet yoke limbs (1*b*) are formed to a closed ring (16) and that this closed ring (16) has attached radially inwardly directed teeth (17), where guide means (19) for the hinged clapper armatures (3), in each case, grip into the tooth gaps (18) of the teeth (17).

21 Claims, 3 Drawing Sheets

Fig. 3
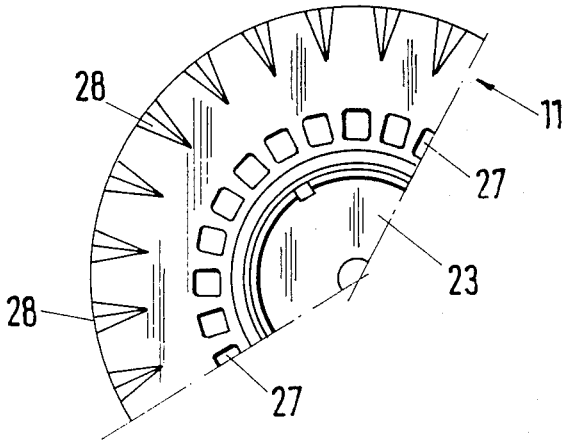
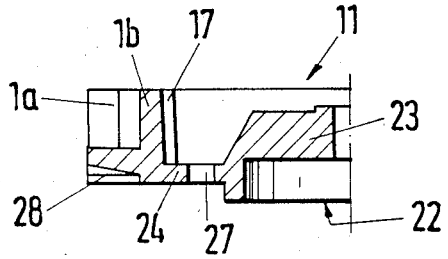
Fig. 4
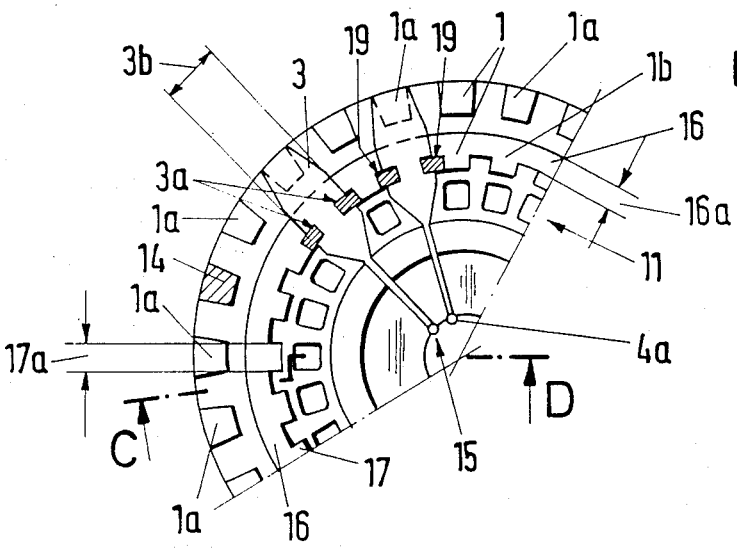
Fig. 5

MATRIX PIN PRINT HEAD OF THE HINGED-CLAPPER-ARMATURE CONSTRUCTION

BACKGROUND OF THE INVENTION

1. Field of the Invention

The invention relates to a matrix pin print head of the hinged-clapper-armature construction with several pin systems, which comprise in each case a magnet yoke limb pair, an electromagnetic coil, a hinged clapper armature, and a print pin, where a higher pin system number determines an outer print head diameter as a nominal diameter, or where a lower pin system number is associated with a smaller print head diameter than the nominal diameter, and where an electromagnetic coil support, which is produced by sintering or by precision casting, forms a single-piece component together with a base plate and the magnet yoke limb pairs.

2. Brief Description of the Background of the Invention Including Prior Art

Such a matrix pin print head is known, for example, from the German Patent Application DE-A1-3,412,855 or from the U.S. Pat. No. 4,230,038. These conventional constructions exhibit U-shaped magnet yoke arm pairs. In this case, the yoke arms are of a rectangular cross-section. However, such a construction requires too large a space and surface area. The problem of position and mold errors occurs during the production. In case of sintered parts or, respectively, of precision casted parts, filling deficiencies occur in the production tool. Such filling deficiencies result in nonuniformities of the magnetic flux. The magnetic flux depends, among other things, on the density of the material employed. In addition, calibration problems of the workpiece are generated. All difficulties are even further increased when the number of the pin systems employed is increased. Thus, in case of 18-pin or 24-pin systems and systems with even more pins, where the nominal diameter remains the same, it is possible only with great difficulty to coordinate the armatures relative to their angle side to the respective magnet yoke limbs or, respectively to guide the armatures.

SUMMARY OF THE INVENTION

1. Purposes of the Invention

It is an object of the present invention to furnish an improved precise armature guide in particular for high-number pin systems, such as 18-pin or 24-pin systems, without a loss of magnetic energy.

It is another object of the present invention to provide structural elements for constructing a matrix pin print head which can be produced and assembled with precision conditions.

It is yet a further object of the present invention to avoid the problems of the conventional structures and to provide a matrix pin print head for easy assembly and of miniature size.

These and other objects and advantages of the present invention will become evident from the description which follows.

2. Brief Description of the Invention

The present invention provides for a matrix pin print head of a hinged clapper armature construction representing multiple pin systems. Each pin system comprises an outer magnet yoke limb and an inner magnet yoke limb. The inner magnet yoke limb forms together with the outer magnet yoke limb a magnet yoke limb pair.

The inner magnet yoke limbs of the multiple pin system are formed to a closed ring. Radially inwardly directed teeth are formed and attached at this closed ring and form tooth gaps between neighboring teeth. Case guide means for the hinged clapper armature grip into the tooth gaps of the inwardly directed teeth. A print pin has a print pin head. A pin engagement point is formed between the pin head and the hinged clapper armature. The magnet yoke limb pair is directed toward the pin engagement point.

An electromagnetic coil support can form together with a base plate and the magnet yoke limb pair in a single-piece component. The outer magnet yoke limb and the electromagnetic coil support can be attached to each other. An electromagnetic coil can be positioned on the electromagnetic coil support. The electromagnetic coil support can be produced by sintering or by precision casting.

A higher pin system number can determine an outer print head diameter to be a nominal diameter, and a lower pin system number can be associated with a lower print head diameter than the nominal diameter.

The guide means for the hinged clapper armature can comprise rail-like protrusions coordinated in pairs to each hinged clapper armature. Said protrusions, in each case, can run in side recesses of the hinged clapper armature and further in side tooth gaps. The armature width less the recesses and the tooth width can be of equal size taking into account production tolerances.

The single-piece component can be formed to a centered hub part. The hub part can comprise a hub floor and a disk. Said disk can connect the hub floor to the closed radially inwardly directed ring. The hub floor can be furnished with a substantially larger thickness as compared to the hub disk. Radially inwardly directed recesses can be furnished in the hub disk and can be distributed over the circumference of the hub disk.

Notches for directing and controlling the magnet flux can be provided, in each case, between two circumferentially neighboring magnet yoke limbs and be disposed axially at the outer periphery of the single-piece component remote from the magnet yoke limb pairs.

According to the invention, the electromagnetic coil support exhibits radially in outward direction individual magnet yoke limbs which are, in each case, directed toward a pin engagement point between the pin head and the hinged clapper armature. The radially inwardly directed magnet yoke limbs are formed to a closed ring and radially inwardly directed teeth are formed at this closed ring. Guide means for the hinged clapper armatures engage in each case in the tooth gaps of the inwardly directed teeth. Advantageously, such an electromagnetic coil support, made by sintering or by precision casting, can be produced with high accuracy and low tolerance values, where neither filling deficiencies occur in the production tool nor calibration problems of the workpiece are observed. In particular, however, the spatial and surface problem is resolved in that the armatures can be advantageously laterally guided. The invention is thus particularly suitable for extremely high-pin-number systems in addition to low-pin-number systems.

According to a further embodiment of the invention, the guide means for the hinged clapper armatures comprise rail-like protrusions, pairwise coordinated to each hinged clapper armature. Said protrusions, in each case, run in side recesses of the hinged clapper armature and further in the side tooth gaps. The armature width less the size of the recesses and the width of the teeth are of equal size taking into account manufacturing tolerances. This construction is associated with the advantage that the cross-sections of the hinged clapper armature and of the magnet yoke limb pairs are adapted to the magnetic flux, as far as this is required.

A further improvement of the invention comprises that the single-piece component, made of sintered material or by precision casting, is further formed and/or developed to a centered hub part. This construction facilitates the affixing of all hinged clapper armatures or, respectively, of all pin systems.

A further advantageous embodiment of the invention comprises that the hub part is formed of a hub floor and of a hub disk, where the hub disk connects the hub floor with the closed radial inner ring. The construction of the electromagnetic coil support consists of individually standing, radially outwardly disposed yoke limbs, radially inwardly disposed yoke limbs which form a closed ring, as well as inwardly directed teeth. Said teeth are coordinated to the radially outwardly disposed yoke limbs by being disposed coordinated, in each case, on a radius intersecting both one of the radially outwardly disposed yoke limbs substantially in the middle and one of the inwardly directed teeth substantially in the middle. The hub part comprises a hub floor and a hub disk. Said hub disk connects the hub floor with the closed radially inwardly disposed ring. Such a structuring favors the production of the electromagnetic coil support substantially and fixes all functionally important components in their relative positions. Such an electromagnetic coil support can therefore be produced with the lowest possible tolerances.

According to a further improvement of the invention, it is disclosed that the hub floor is formed of a substantially larger thickness than the hub disk. This construction leads to a particular mass distribution in the region of the support of a damper ring to be described below, such that the rebound features of the hinged clapper armatures with the print pins are transferred into a particularly favorable vibrational and oscillation frequency region.

A guiding of the magnetic flux as well as a material saving is also achieved by furnishing radially inwardly directed recesses in the hub disk, which radially inwardly directed recesses are distributed over the circumference of the hub disk.

Further advantageous features relating to the influencing of the magnetic flux or, respectively, for a favorable and economic production of the electromagnetic coil support are achieved by furnishing notches for the magnetic flux control at the single-piece component, axially averted relative to the magnet yoke limb pairs, and located between, in each case, two magnet yoke limbs neighboring at the circumference.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 3 is a partial and detailed view from below of the electromagnetic coil support in direction A according to FIG. 2, FIG. 4 is a cross-sectional view according to section line C–D of FIG. 5, and FIG. 5 is a top plan view onto the embodiment of FIG. 4 or, respectively, in the direction B according to FIG. 2.

DESCRIPTION OF INVENTION AND PREFERRED EMBODIMENT

Figure 1:
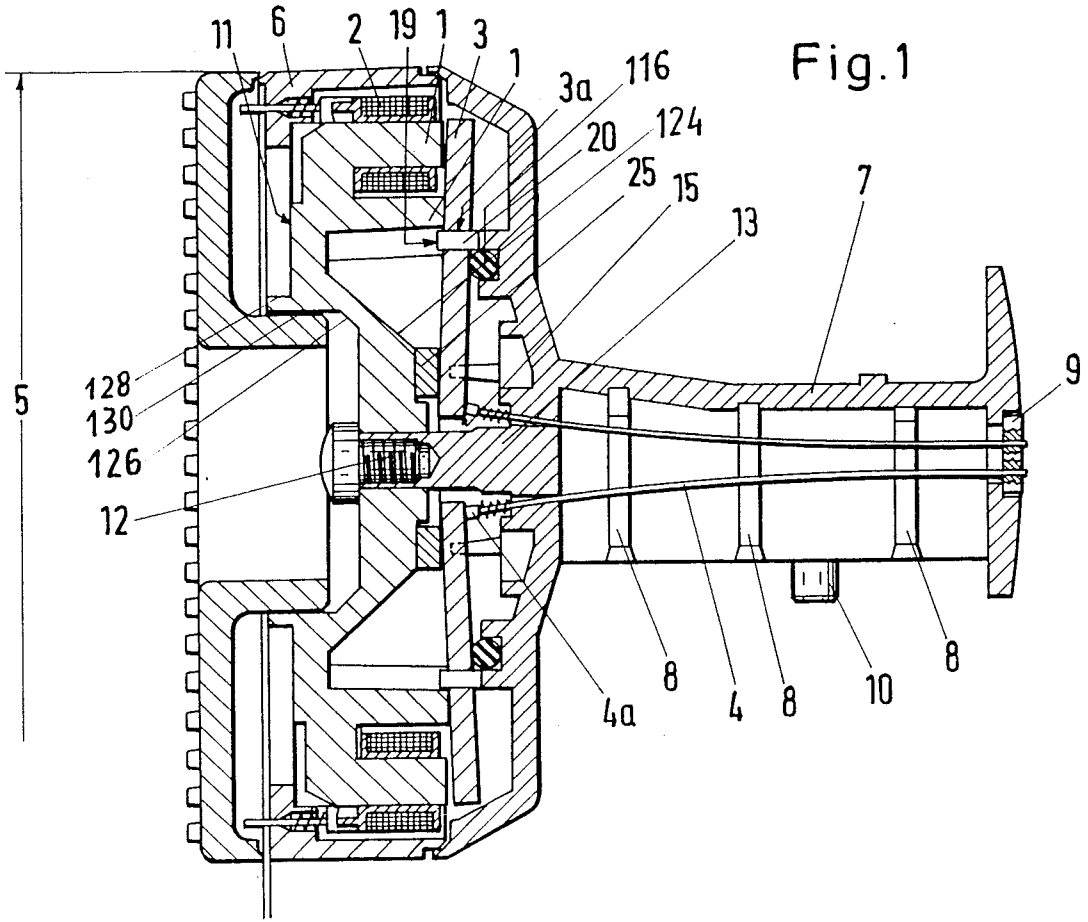
FIG. 1 shows an axial cross-section through a longitudinal axis of a matrix pin print head.

In accordance with the present invention, there is provided a matrix pin print head of a hinged clapper armature construction with several pin systems. Said pin systems, in each case, comprise a magnet yoke limb pair 1, an electromagnetic coil 2, a hinged clapper armature 3, and a print pin 4. A higher pin system number determines an outer print head diameter, to be a nominal diameter 5, and a lower pin system number is associated with a lower print head diameter than the nominal diameter 5. An electromagnetic coil support 11, produced by sintering or by precision casting, is provided. The electromagnetic coil support 11, together with a base plate and the magnet yoke limb pairs 1, forms a single-piece component 21. The electromagnetic coil support 11 exhibits radially outwardly directed individual magnet yoke limbs 1*a*. Said magnet yoke limbs 1*a* are directed in each case toward a pin engagement point 15 between the pin head 4*a* and the hinged clapper armature 3. The radially inwardly disposed magnet yoke limbs 1*b* are formed to a closed ring 16. Radially inwardly directed teeth 17 are formed and attached at this closed ring 16. In each case, guide means 19 for the hinged clapper armature 3 grip into the tooth gaps 18 of the inwardly directed teeth 17.

The guide means 19 for the hinged clapper armature 3 can comprise rail-like protrusions 20 coordinated in pairs to each hinged clapper armature 3. Said protrusions 20, in each case, can run in side recesses 3*a* of the hinged clapper armature 3 and further in side tooth gaps 18. The armature width 3*b* less the recesses 3*a* and the tooth width 17*a* can be of equal size taking into account production tolerances.

The single-piece component 21 can be formed by sintering or by precision casting to a centered hub part 22. The hub part 22 can comprise a hub floor 23 and a disk 24. Said disk 24 can connect the hub floor 23 with the closed radially inwardly directed ring 16. The hub floor 23 can be furnished with a substantially larger thickness as compared to the hub disk 24. Radially inwardly directed recesses 27 can be furnished in the hub disk 24 and can be distributed over the circumference of the hub disk 24.

Notches 28 for directing and controlling the magnet flux can be provided, in each case, between two circumferentially neighboring magnet yoke limbs 1*a* and can be disposed axially at the single-piece component 21 remote from the magnet yoke limb pairs 1.

The matrix pin print head of the hinged clapper armature construction, as illustrated in FIG. 1, exhibits for example 9, 18, or 24-pin systems which, in each case, comprise a magnet yoke limb pair 1, an electromagnetic coil 2 positioned around one of the magnet yoke limbs 1*a* , a hinged clapper armature 3, swinging around an elastic ring 116, and a print pin 4. The number of 9, 18, or 24 of these pin systems determines a nominal diameter 5. In the embodiment illustrated, the pin system number amounts to 24, as illustrated in FIG. 2.

The matrix pin print head is further subdivided into a rear print head casing 6 and a front print head casing 7. The print pins 4 are guided or, respectively, supported by way of support and guiding disks 8 in the front print head casing 7. All 24 print pins 4 are guided together to two pin slots in a mouth piece 9. The complete matrix pin print head is furthermore adjusted and attached by two guide pins 10 on a print head carriage, not further illustrated here.

Nearly all system components are disposed in the rear print head casing 6 and, in addition, there is furnished an electromagnetic coil support 11, which is illustrated in more detail in FIGS. 2 to 5. The electromagnetic coil support 11 connects the rear print head casing 6 with a screw 12 via a casing hub 13 to the front print head casing 7.

Figure 2:
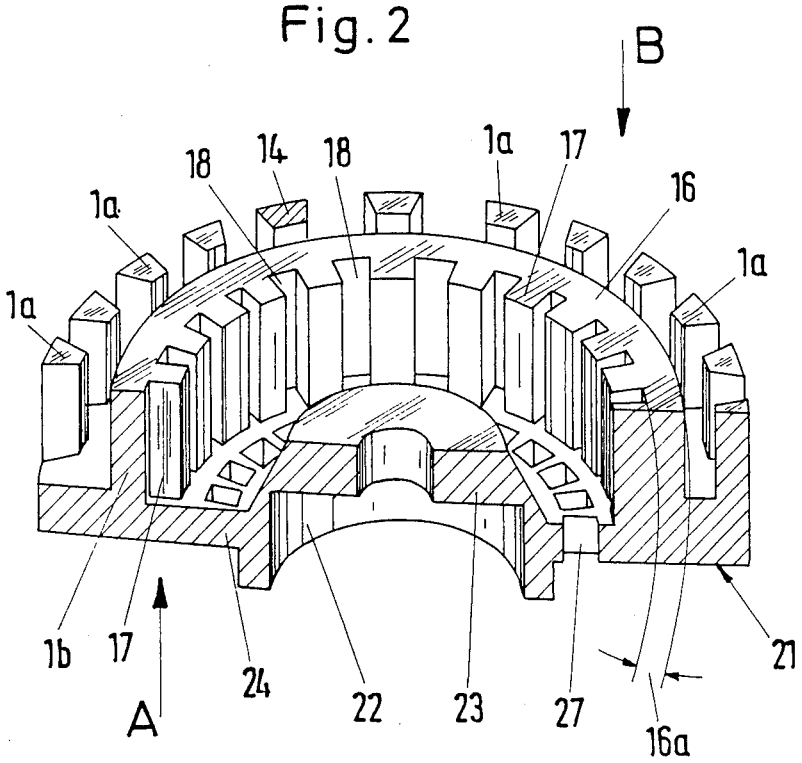
FIG. 2 is a perspective cross-sectional view through the electromagnetic coil support.

The electromagnetic coil support 11 comprises disposed radially outwardly, as illustrated in FIG. 2, individual magnet yoke limbs 1*a*. Said individual magnet yoke limbs 1*a* are directed in their cross-section 14 in a radial direction substantially to a pin engagement point 15, as illustrated in FIG. 1. Thereby, the intermediate space is used optimally for the electromagnetic coil 2. The radially inwardly disposed magnet yoke limbs 1*b*, disposed opposite to each other, are gathered together in a closed ring 16 in contrast to the individual magnet yoke limbs 1*a*. This ring 16 constitutes the precondition for further structural features which include supporting the hinged clapper armature 3 and to guide the hinged clapper armature 3. For this purpose, radially inwardly directed teeth 17 are disposed at the closed ring 16. In fact, the teeth 17 are disposed such that the ring width 16*a* is increased by a tooth 17 in radial direction, thereby achieving an increase of the face through which the magnetic flux lines are to be guided. Simultaneously, however, a tooth gap 18 is generated by a tooth 17, where the guide means 19, illustrated in FIG. 1, for the hinged clapper armature 3 can engage into the tooth gap 18 without their sides interfering with each other.

The pin engagement point 15 can include a hinged clapper armature 3, at which a print pin head 4*a* is loosely resting. However, the hinged clapper armature 3, can also be fixedly connected to the print pin 4 at the pin engagement point 15, for example by welding.

According to the embodiment illustrated, the guide means 19 include rail-like protrusions 20 which, in each case, are disposed in side recesses 3*a* on the side of the hinged clapper armatures 3. These side recesses 3*a* of the hinged clapper armatures 3 allow a sliding motion of the hinged clapper armature 3 at the fixedly disposed protrusions 20. According to FIG. 1, the fixedly disposed, rail-like protrusions 20 are molded directly to the front print head casing 7 made of plastic. The described sliding ability is generated within tolerance limits by allowing the protrusions 20 to run in the tooth gaps 18, where the armature width 3*b* less the recesses 3*a*, disposed on two opposed sides of the armatures 3, and the tooth width 17*a* are of equal size, taking into consideration tolerance allowances.

The electromagnetic coil support 11 is constructed according to FIGS. 2 to 5 as a single-piece sintered or precision-cast component 21, whereby a high production precision results relative to shape, position, and dimensions for the magnet yoke limbs 1*a*, the centering of the closed ring 16, for the teeth 17, and for the tooth gaps 18, as well as the tooth width 17*a*. This precision is also assured within the rear print head casing 6 by providing that the single-piece component 21 is further developed to a center hub part 22 made by sintering or by precision casting. The hub part 22 comprises a hub floor 23 and a hub disk 24. Said hub disk 24 connects the hub part 22 with the radially inwardly disposed ring 16. A damper disk 25 rests at the hub floor 23, as illustrated in FIG. 1. This damping of the motions of the hinged clapper armature 3 is further improved by a substantially larger thickness 26 of the hub floor 23 versus the hub disk 24, as illustrated in FIG. 4.

The single-piece component 21 can furthermore be easily constructed by providing radially inwardly directed recesses 27, which are located in and distributed over the circumference of the hub disk 24.

Further savings relating to materials are possible, however, these can induce and influence the functioning, by furnishing notches 28 between, in each case, two magnet yoke limbs 1*a* neighboring at the circumference of the single-piece component 21. The notches 28 furthermore influence a steering and control of the magnetic flux.

The hub floor 23 can have a thickness of from about 0.8 to 1.5 times the thickness of the bottom part of the U-part of the yoke and preferably from about 1.0 to 1.2 times the thickness of the bottom part of the U-part of the yoke.

The hub floor 23 can have a thickness of from about 1.0 to 2.0 times that of the hub disk 24 and preferably of from about 1.2 to 1.6 times the thickness of the hub disk 24.

The radial extension of the teeth 17 can be from about 0.5 to 1.0 times and preferably from about 0.6 to 0.8 times the thickness of the ring 16. The radial extension of the guide means 19 can be from about 0.5 to 1.0 times the radial extension of the teeth 17 and is preferably from about 0.7 to 0.9 times the radial extension of the teeth 17.

The radial extension of the outer magnet yoke limbs 1*a* can be from about 0.7 to 1.1, and preferably from about 0.8 to 1.0, times the radial extension of the sum of the width of the ring 16 and of the teeth 17 in radial extension. The upper end of the ring 16, of the teeth 17, and of the magnet yoke limbs 1*a* are of about equal level.

The hub disk 24 and the hub floor 23 can be connected on their upper sides by an inclined conical surface with an angle of from about 30 to 60 degrees relative to a horizontal plane and, preferably, a cone angle of from about 40 to 50 degrees.

The bottom side face of the hub floor 23 can be disposed above the upper side face of the hub disk 24 by an amount of from about 0.5 to 2.0 times the thickness of the disk 24. The connection thickness of the area with the inclined conical surface 124 can have a thickness of from about 0.3 to 1.0 times and preferably from about 0.4 to 0.7 times the thickness of the hub disk 24. The hub disk 24 can be fitted radially inwardly and into a cylindrical inner face joining the horizontally disposed lower side of the hub floor 23 via a small adapting area. The connection region 126 between the inner cylindrical area and the lower side face can have an extension which is from about 0.01 to about 0.2 times the length of the frustum-conical surface 124 connecting the upper surface of the hub disk 24 and the upper surface of the hub floor 23. The top side of the hub floor 23 can be provided with an annular outer recess which serves to accommodate in its position a damper disk 25.

The thickness of the damper disk 25 can be from about 0.3 to 1.0 times, and is preferably from about 0.4 to 0.6 times the thickness of the hub disk 24. The protrusion of the guide means 19 to below the upper level of the teeth 17 can be from about 0.1 to 1.0 times the thickness of the hub disk 24 and is preferably from about 0.15 to 0.3 times the thickness of the hub disk 24.

Preferably, the area between the hub disk 24 and the hub floor 23 is furnished with a lower collar 128, which extends the cylinder part illustrated at the hub part 22 in FIG. 2, downwardly by an amount below the lower side of the hub disk 24 which can be from about 0.5 to 2.0 times the thickness of the hub disk 24. This cylindrical section 130 can serve to be fitted with a lower cover which would protect and possibly connect the electromagnetic coils 2. The center of the hub floor 23 can have a centered opening through which a part of the front print head casing can be matched. The part of the front print head casing matching the center bore in the hub floor 23 can have a threaded hole for accepting a screw or bolt adapted to hold the front print head casing to the rear print head casing. The outer diameter corresponding to the outside of the magnet yoke limb 1*a* can correspond to a radius which is from about 2.0 to 4.0 times, and preferably from about 2.2 to 3.0 times the diameter of the inner cylindrical section 130 limiting the hub disk 24 on the inner side. The thickness of the hub floor 23 can be from about 0.5 to 1.0 times the length of the outer magnet yoke limb 1*a* and is preferably from about 0.6 to 0.8 times the length of the outer magnet yoke limb 1*a*. The guide means 19 is preferably disposed next to and flush with an opening holding a support element around which the actuated hinged clapper armature 3 turns. Thus, the hinged clapper armature 3 is guided substantially in the area of the smallest lever motion right next to the area of the pivot center.

It will be understood that each of the elements described above, or two or more together, may also find a useful application in other types of matrix print heads differing from the types described above.

While the invention has been illustrated and described as embodied in the context of a matrix pin print head of the hinged clapper armature construction with several systems, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A matrix pin print head of a hinged clapper armature construction representing multiple pin systems with each pin system comprising an outer magnet yoke limb;

an inner magnet yoke limb forming together with the outer magnet yoke limb a magnet yoke limb pair and wherein the inner magnet yoke limbs of the multiple pin system represent a closed ring;

radially inwardly directed teeth formed and attached to and projecting inwardly from said closed ring and forming tooth gaps between neighboring teeth;

a hinged clapper armature;

case guide means for the hinged clapper armature protruding from a side of the armature opposite to the magnet into the tooth gaps of the inwardly directed teeth such as to define the position of the hinged clapper armature near the radial positioning of the inwardly directed teeth;

a print pin having a print pin head, wherein a pin engagement point is formed between the pin head and the hinged clapper armature, and wherein the magnet yoke limb pair is directed toward the pin engagement point.

2. The matrix pin print head according to claim 1 further comprising a base plate;

an electromagnetic coil support forming together with the base plate and the magnet yoke limb pair a single-piece component, and wherein the outer magnet yoke limb and the electromagnetic coil support are attached to each other; an electromagnetic coil positioned on the electromagnetic coil support.

3. The matrix pin print head according to claim 1 wherein the electromagnetic coil support is produced by sintering.

4. The matrix pin print head according to claim 1 wherein the electromagnetic coil support is produced by precision casting.

5. The matrix pin print head according to claim 1 wherein a pin system number of 18 and higher determines an outer print head diameter to be a nominal diameter, and wherein a pin system number of 9 and lower is associated with a lower print head diameter than the nominal diameter.

6. The matrix pin print head according to claim 1, wherein notches for directing and controlling a magnet flux are provided, in each case, between two circumferentially neighboring magnet yoke limbs and are disposed axially at the outer periphery of the single-piece component remote from the magnet yoke limb pairs.

7. The matrix pin print head according to claim 1, wherein the radial extension of the teeth is from about 0.5 to 1.0 times the thickness of the ring, and wherein the radial extension of the guide means is from about 0.5 to 1.0 times the radial extension of the teeth; and wherein the radial extension of the outer magnet yoke limbs is from about 0.7 to 1.1 times the radial extension of the sum of the width of the ring and of the teeth in radial extension.

8. The matrix pin print head according to claim 1, wherein the radial extension of the teeth is from about 0.6 to 0.8 times the thickness of the ring, and wherein the radial extension of the guide means is from about from about 0.7 to 0.9 times the radial extension of the teeth;

wherein the radial extension of the outer magnet yoke limbs is from about 0.8 to 1.0, times the radial extension of the sum of the width of the ring and of the teeth in radial extension; and wherein the upper end of the ring, of the teeth, and of the outer magnet yoke limbs are of about equal level.

9. The matrix pin print head according to claim 1 wherein the guide means for the hinged clapper armature comprise rail-like protrusions furnished in pairs to each hinged clapper armature, which protrusions, in each case, run in side recesses of the hinged clapper armature and further in side tooth gaps.

10. The matrix pin print head according to claim 9, wherein the armature width less the recesses and the tooth width are of equal size disregarding differences amounting to production tolerances of the matrix pin print head.

11. The matrix pin print head according to claim 2, wherein the single-piece component is formed to a centered hub part.

12. The matrix pin print head according to claim 11, wherein the hub part comprises a hub floor and a disk, which disk connects the hub floor to the closed ring which is directed radially inwardly.

13. The matrix pin print head according to claim 12, wherein the hub floor exhibits a substantially larger thickness as compared to the hub disk.

14. The matrix pin print head according to claim 12, wherein radially inwardly directed recesses are disposed in the hub disk and are distributed over the circumference of the hub disk.

15. A matrix pin print head of a hinged clapper armature construction with several pin systems which, in each case, comprise a magnet yoke limb pair (1), an electromagnetic coil (2), a hinged clapper armature (3), and a print pin (4), wherein a higher pin system number determines an outer print head diameter, to be a nominal diameter (5), and wherein a lower pin system number is associated with a lower print head diameter than the nominal diameter (5), and wherein further an electromagnetic coil support (11), produced by sintering or by precision casting, is provided, and where the electromagnetic coil support (11), together with a base plate and the magnet yoke limb pairs (1), forms a single-piece component (21), wherein the electromagnetic coil support (11) exhibits radially outwardly directed individual magnet yoke limbs (1*a*), which magnet yoke limbs (1*a*) are directed in each case toward a pin engagement point (15) between the pin head (4*a*) and the hinged clapper armature (3), and wherein the radially inwardly disposed magnet yoke limbs (1*b*) are formed to a closed ring (16), and where radially inwardly directed teeth (17) are formed and attached to and projecting inwardly from said closed ring (16), where in each case guide means (19) for the hinged clapper armature (3) are positioned into the tooth gaps (18) of the inwardly directed teeth (17).

16. The matrix pin print head according to claim 15, wherein the guide means (19) for the hinged clapper armature (3) comprise rail-like protrusions (20) coordinated in pairs to each hinged clapper armature (3), which protrusions (20), in each case, run in side recesses (3*a*) of the hinged clapper armature (3) and further in side tooth gaps (18), wherein the armature width (3*b*) less the recesses (3*a*) and the tooth width (17*a*) are of equal size taking into account production tolerances.

17. The matrix pin print head according to claim 15, wherein notches (28) for directing and controlling the magnet flux are provided, in each case, between two circumferentially neighboring magnet yoke limbs (1*a*) and are disposed axially at the single-piece component (21) remote from the magnet yoke limb pairs (1).

18. The matrix pin print head according to claim 15, wherein the single-piece component (21) is formed by sintering or by precision casting to a centered hub part (22).

19. The matrix pin print head according to claim 18, wherein the hub part (22) comprises a hub floor (23) and a disk (24), which disk (24) connects the hub floor (23) with the closed radially inwardly directed ring (16).

20. The matrix pin print head according to claim 19, wherein the hub floor (23) is furnished with a larger thickness as compared to the hub disk (24).

21. The matrix pin print head according to claim 17, wherein radially inwardly directed recesses (27) are disposed in the hub disk (24) and are distributed over the circumference of the hub disk (24).

* * * * *